US009634416B2

(12) United States Patent
Hein et al.

(10) Patent No.: US 9,634,416 B2
(45) Date of Patent: Apr. 25, 2017

(54) ELECTRICAL CONNECTION ARRANGEMENT

(71) Applicant: WABCO GmbH, Hannover (DE)

(72) Inventors: Joachim Hein, Hannover (DE); Nico Herzberg, Wedemark (DE)

(73) Assignee: WABCO GmbH, Hannover (DE)

( * ) Notice: Subject to any disclaimer, the term of this patent is extended or adjusted under 35 U.S.C. 154(b) by 0 days.

(21) Appl. No.: 15/028,995

(22) PCT Filed: Oct. 22, 2014

(86) PCT No.: PCT/EP2014/002849
§ 371 (c)(1),
(2) Date: Apr. 13, 2016

(87) PCT Pub. No.: WO2015/067347
PCT Pub. Date: May 14, 2015

(65) Prior Publication Data

US 2016/0276770 A1 Sep. 22, 2016

(30) Foreign Application Priority Data

Nov. 9, 2013 (DE) ..... 10 2013 018 851

(51) Int. Cl.
*H01R 13/24* (2006.01)
*H01R 12/57* (2011.01)
(Continued)

(52) U.S. Cl.
CPC ..... *H01R 13/2421* (2013.01); *H01R 12/57* (2013.01); *H01R 12/7076* (2013.01);
(Continued)

(58) Field of Classification Search
CPC .... H01R 12/57; H01R 12/707; H01R 12/718; H01R 13/2421; H01R 13/33; H01R 12/7076
(Continued)

(56) References Cited

U.S. PATENT DOCUMENTS 6,174,174 B1 1/2001 Suzuki et al.
6,551,112 B1 * 4/2003 Li ..... G01R 1/0466 439/66
(Continued)

FOREIGN PATENT DOCUMENTS

DE 10244760 A1 10/2003
DE 102004041207 A1 3/2006
(Continued)

OTHER PUBLICATIONS

European Patent Office, Rijswijk, Netherlands, International Search Report of International Application No. PCT/EP2014/002849, mailed Jan. 14, 2015, 3 pages.

*Primary Examiner* — Edwin A. Leon
(74) *Attorney, Agent, or Firm* — Brinks Gilson & Lione

(57) ABSTRACT

A connection arrangement (10) for electrically connecting at least one sensor (12) or actuator to at least one conductor track (22) on a circuit board (24) has at least one compression spring (18) for electrically conductive connection. The compression spring (18) is arranged between the at least one sensor (12) or actuator and the circuit board (24) so as to be under a mechanical preload. The compression spring has a contact end section (36) of the at least one compression spring (18) configured to rest against a contact plate (20, 70, 80, 90) that is electrically conductively connected to the conductor track (22). As a result, the connection arrangement (10) achieves a high level of electrical contact reliability and corrosion-resistance.

17 Claims, 2 Drawing Sheets

(51) Int. Cl.
*H01R 13/33* (2006.01)
*H01R 12/71* (2011.01)
*H01R 12/70* (2011.01)

(52) U.S. Cl.
CPC ..... *H01R 12/718* (2013.01); *H01R 13/33* (2013.01); *H01R 12/707* (2013.01)

(58) Field of Classification Search
USPC ..... 439/700, 66
See application file for complete search history.

(56) References Cited

U.S. PATENT DOCUMENTS

| | | | | |
|---|---|---|---|---|
| 6,866,519 | B2 * | 3/2005 | Fan ..... | H01R 13/2421 439/66 |
| 7,404,717 | B2 * | 7/2008 | Kazama ..... | H01R 13/2421 439/66 |
| 7,491,069 | B1 | 2/2009 | Di Stefano et al. | |
| 2003/0176083 | A1 | 9/2003 | Li et al. | |
| 2004/0075168 | A1 | 4/2004 | Azuma | |
| 2011/0121850 | A1 | 5/2011 | Lee | |

FOREIGN PATENT DOCUMENTS

| | | | |
|---|---|---|---|
| DE | 102011075901 | A1 | 11/2012 |
| DE | 102013104237 | A1 | 10/2014 |

* cited by examiner

ELECTRICAL CONNECTION ARRANGEMENT

TECHNICAL FIELD

The invention relates to a connection arrangement for electrically connecting at least one sensor or actuator to at least one conductor track on a circuit board, wherein the at least one sensor or actuator has at least one compression spring for electrically conductive connection, and the at least one compression spring is arranged between the at least one sensor or actuator and the circuit board so as to be under a mechanical preload.

BACKGROUND

Contact surfaces for connections that are particularly corrosion-resistant and provide reliable electrical conduction between electronic circuit boards and other electronic or electrical components are usually produced from tin, silver or gold. For electronic applications in motor vehicles, which are exposed to extreme environmental effects, contact arrangements which are based on spring elements and connection structures with a complex geometry are furthermore known. These spring elements and connection structures are provided with a surface finish made of tin, silver or gold and are then connected in an electrically conductive manner to the circuit board. However, the complexity of the spring elements used and of the connection structures leads to high production costs and quite often requires a larger installation space.

Electrical contact arrangements which use a metal compression spring supported on a conductor track or a contact path of a circuit board to electrically connect an external component, e.g. a solenoid valve or a sensor, are furthermore known for use in motor vehicles. In such a structure, a gold-plated contact spring and a conductor track composed of copper as the base material, which is gold-plated at least in the contact zone, are employed as contact partners in such a structure, for example, the spring and the conductor track being very largely impervious to damaging corrosive climatic effects and therefore allowing reliable electrical connection. However, a barrier layer of nickel is required for cost-effective gold-plating in order to suppress diffusion processes. However, it is precisely this barrier layer which has proven sensitive to climatic effects, especially in combination with the known press-fit technology, in which electrical components are secured mechanically in circuit board holes that are metal-coated or provided with metal sleeves simply by being pressed in and, at the same time, are brought into electrical contact with the conductor tracks of the circuit board, and this sensitivity can lead to the formation of cracks, subsurface corrosion and local corrosion at the contact points.

Chemical corrosion effects and/or frictional corrosion phenomena can also occur with other pairs of materials for the contact spring and the circuit board, such as silver-silver, silver-tin or silver-tin solder, in the presence of dis-advantageous climatic effects, vibration-related relative movements between the contact spring and the circuit board and/or in the case of relatively high cur-rent loads, and the consequences of these corrosion effects or phenomena can extend to total failure of the electrical contact point concerned.

DE 102 44 760 A1 discloses a pressure sensor subassembly having an electrical connection for a measuring element. The electrical connection between the measuring elements and a plurality of contacts, which are embedded in a contact support surrounding the measuring elements, is obtained by means of a "bond" by microwelding. The external electrical connection of the pressure sensor subassembly is accomplished by means of a plurality of spring contacts embodied in the manner of helical compression springs, which are each passed through an opening in an insertion funnel which, for its part, is arranged in a pressure sensor housing. The spring contacts are supported between the contacts in the contact support and an external abutment. Within the pressure sensor housing, the spring contact is wound to form a solid block so as to be axially rigid under pressure, while, outside the pressure sensor housing, the spring contact can deflect in an axial direction. Direct electrical connection of a circuit board with the aid of the spring contacts is not envisaged.

SUMMARY OF THE INVENTION

It is the underlying object of the invention to present a connection arrangement for the electrically reliable connection of a sensor and/or an actuator to a circuit board which is of simple construction and, in particular, is resistant to frictional corrosion and other corrosion processes.

Here, the invention starts from the insight that external components can be brought into contact with conductor tracks on a circuit board with the aid of compression springs in a manner which is simple in terms of design and is furthermore electrically reliable.

The invention therefore relates to a connection arrangement for electrically connecting at least one sensor or actuator to at least one conductor track on a circuit board, wherein the at least one sensor or actuator has at least one compression spring for electrically conductive connection, and the at least one compression spring is arranged between the at least one sensor or actuator and the circuit board so as to be under a mechanical preload. To achieve the object, it is envisaged that, to ensure reliable electrical connection, a contact end section—facing the circuit board—of the at least one compression spring rests against a contact plate that is electrically conductively connected to the conductor track.

By means of the proposed structure, a connection arrangement is obtained which allows vibration-resistant or corrosion-resistant connection of an external component, e.g. a sensor or actuator, to an electronic circuit board. Since this connection arrangement renders gold-plating of conductor tracks unnecessary, the circuit board can be produced at a reasonable cost and its compatibility with the use of press-fit technology is unproblematic. Moreover, the compression spring allows axial tolerance compensation and the compensation of thermal expansions and manufacturing tolerances.

In order to achieve a compression spring contact surface which is as large in area as possible and is seated as well as possible, provision can be made for the last turn of the contact end section of the compression spring to be ground flat. It is furthermore possible, for this purpose, for the final turns of the contact end section of the compression spring to be wound to form a solid block and, as a result, to be axially rigid under pressure.

In the context of this description, the term "corrosion" is taken to refer both to frictional corrosion processes and to chemical or electrochemical corrosion processes. Frictional corrosion processes arise when, for example, vibration-induced relative movements occur between the compression spring and the contact plate. In this case, microscopically small metal particles are detached and abraded owing to the movement of the contact partners, the outcome being a reduction in the effective metal contact surface, among the possible effects of which is an increase in electrical contact resistance. In contrast, the term "chemical corrosion" relates primarily to chemical reactions between a material, generally metallic, with substances from its environment. In the case of electrochemical corrosion processes, there is not only a change in the substances but also a flow of electric current.

Without any claim to completeness, suitable sensors include pressure sensors, temperature sensors, speed sensors, displacement sensors, acceleration sensors and magnetic sensors, for example, while the actuators can be solenoid valves, servomotors, electromagnets, "piezo stacks" or the like, for example.

The number of compression springs preferably corresponds to the number of contact plates. The diameter of the spring wire used to wind the compression spring, the outside diameter of the compression spring in relation to the overall length or height thereof and the number of turns or pitch angle of the turns are dimensioned in such a way that the compression spring does not buckle in a radial direction, taking into account the mechanical preload selected in order to create a sufficient contact pressure and all the mechanical loads which arise during actual operation of the connection arrangement.

According to one embodiment of the connection arrangement described, provision can be made for the thickness of the contact plate to be at least twice as great as the thickness of the conductor track electrically conductively connected to the contact plate. This results in a high abrasion resistance of the contact plate, which makes it insensitive particularly to frictional corrosion processes.

Provision can furthermore be made for the contact plate to be formed from or with a copper-tin alloy, in particular as a CuSn6 alloy. This makes it possible to have recourse to a metal alloy which is widely available in the electrical industry and is inexpensive and which furthermore can be subjected to further processing without problems by means of the known manufacturing and joining methods. Instead of the CuSn6 alloy from the large group comprising bronzes, which is presented here purely by way of example, it is also possible to use other bronze alloys or other metal alloys for the contact plate. In contrast, the conductor tracks of the circuit board are preferably formed from chemically pure copper or with a copper alloy.

According to another advantageous development, it is envisaged that the compression spring is provided with a passivated silver coating, at least in some area or areas. This gives a high electrical surface conductivity of the compression spring with, at the same time, good corrosion resistance. In principle, the application of the passivated silver coating in the contact end section of the compression spring is sufficient since it is here that the actual electrical contacting takes place.

It can furthermore be envisaged that an upper side—facing the contact end section of the compression spring—of the contact plate is provided with a passivated silver coating. This results in a low electrical contact resistance between the contact end section of the compression spring and the contact plate with, at the same time, high resistance to climatic corrosion. In addition, the outer surfaces or outer edges of the contact plate can also be provided with a passivated silver coating in order to achieve very good corrosion protection here too.

In this context, it is regarded as advantageous if the thickness of the silver coating of the compression spring and that of the silver coating of the con-tact plate are the same. The respective silver coating is preferably applied by electrodeposition. Independently of an equally thick coating with silver, it is envisaged, according to another embodiment, that the layer thickness of the silver coating of the compression spring and the layer thickness of the silver coating of the contact plate are 2 μm to 5 μm, although greater layer thicknesses are also possible. These layer thicknesses are quite large and thus allow very good corrosion and abrasion resistance of the contact partners. In comparison, chemical coating of the compression spring and/or of the contact plate with silver is possible only in layer thicknesses of 0.15 μm to 0.45 μm, and passivation of chemically applied silver is not usual. The corrosion resistance of the copper of the conductor tracks which is arranged under such thin layers is correspondingly low. As already described, a chemically applied coating of gold additionally requires a barrier layer of nickel.

According to another embodiment, it is envisaged that an underside—facing the at least one conductor track—of the contact plate is tin-coated, at least in some area or areas. Excellent solderability of the contact plate to the circuit board or to the at least one conductor track thereof is thereby obtained. To make the contact plate better suited to processing in a soldering process, e.g. in a standard SMD soldering operation, the underside of the contact plate can, if appropriate, be provided in some area or areas with a suitable adhesive to maintain the position against sliding before the soldering operation.

Another development of the invention envisages that the surface of the contact plate extends beyond the outside diameter of the contact end section of the compression spring on all sides. Reliable electrical contacting with an electrical contact zone which is as large as possible is thereby obtained.

According to another embodiment, it is envisaged that, in the region of the contact plate, the surface of the at least one conductor track of the circuit board extends beyond the contact plate on all sides. A narrow encircling edge zone around the contact plate is thereby kept free for a meniscus which generally forms as the contact plate is soldered to a conductor track of the circuit board owing to capillary forces and the surface tension of the solder used.

It is furthermore possible to envisage that the contact plate has a depression in the region of its upper side to at least partially accommodate the contact end section of the at least one compression spring. Position retention of the compression spring in relation to the contact plate is thereby obtained. At the same time, the depression within the contact plate can be matched to the shaping of the contact end section in order to provide a contact surface which is as large as possible and to increase the current carrying capacity of the connection arrangement.

According to another embodiment, the compression spring is a cylindrical helical compression spring. A compression spring designed in this way can be produced relatively simply and inexpensively.

Finally, provision can be made for the contact plate to have an at least quadrilateral peripheral geometry, a circular peripheral geometry, an elliptical peripheral geometry, an oval peripheral geometry or a combination of at least two of the peripheral geometries. As a result, the peripheral geometry of the contact plate corresponds to the connection surface geometries or contact surface geometries that are generally used on circuit boards.

To further illustrate the invention, drawings of illustrative embodiments are attached to the description.

BRIEF DESCRIPTION OF THE DRAWINGS

In the drawings.

In the drawings, the same design elements have the same reference numeral in each case.

DETAILED DESCRIPTION OF THE DRAWINGS

Figure 1:
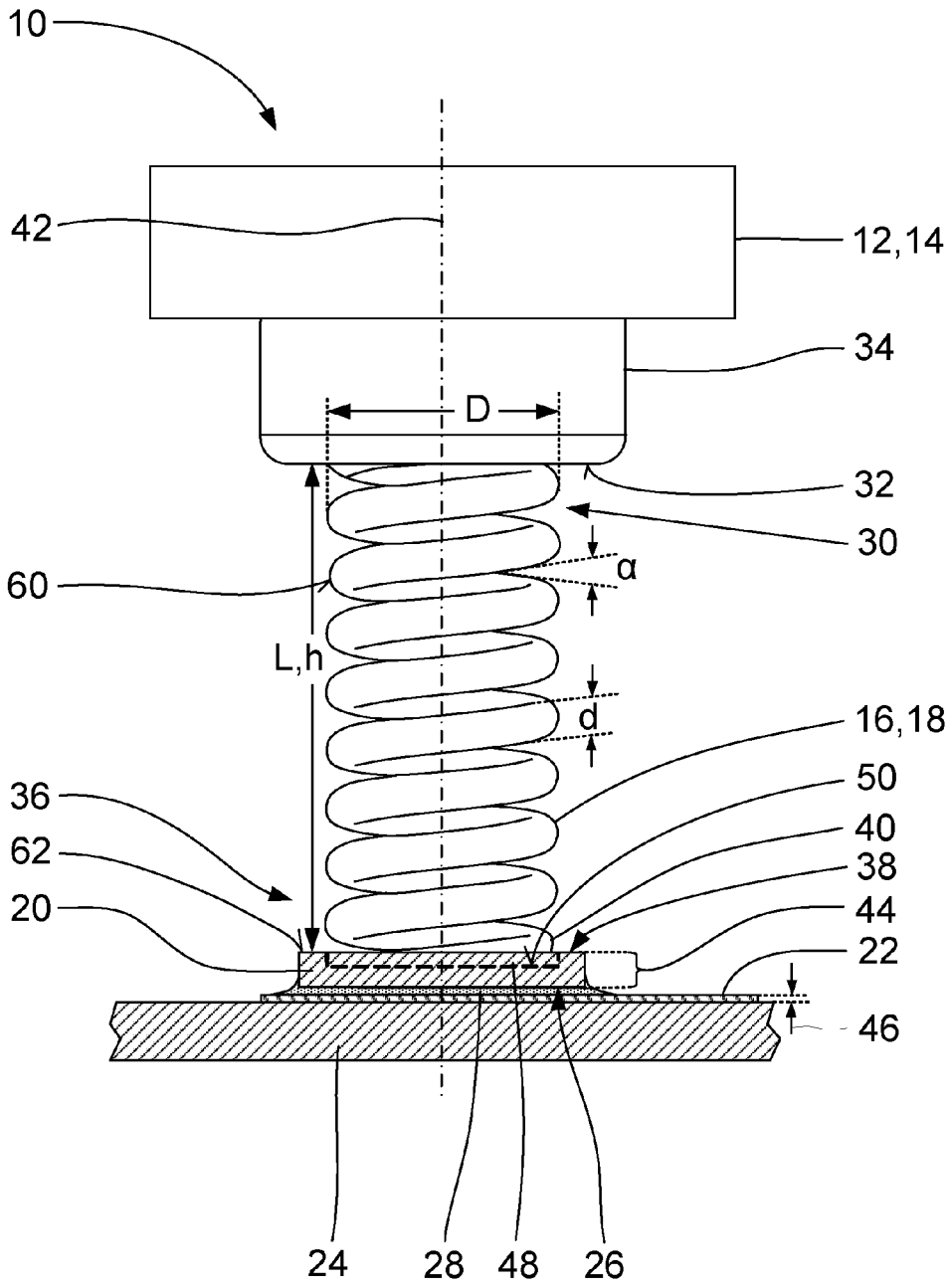
FIG. 1 shows a schematic side view of a connection arrangement according to the invention.

The connection arrangement 10 shown in FIG. 1 has a sensor 14, which is designed as a pressure sensor 12 here by way of example and which is connected in an electrically conductive manner, by means of a compression spring 18 embodied as a cylindrical helical compression spring 16, to a contact plate 20, which, for its part, is connected in an electrically conductive manner to a conductor track 22 arranged on a circuit board 24. Instead of the pressure sensor 12, it is also possible to make electrical contact between an actuator, e.g. a solenoid valve, a servomotor or the like, and the conductor track 22 of the circuit board 24 by means of the connection arrangement 10.

An underside 26 of the contact plate 20 is joined thermally to the conductor track 22 by means of a soldered joint 28 to produce an electrically conductive connection and to secure the contact plate 20 mechanically on the circuit board 24. Instead of a soldered joint 28, it is also possible to use other joining methods, which allow a comparably low-resistance connection between the contact plate 20 and the conductor track 22. A sensor-side end section 30 of the helical compression spring 16 facing away from the circuit board 24 is integrated into a housing 34 of the pressure sensor 12 in the region of a housing underside 32 to allow electrical connection of the measuring elements (not shown) and of an optional electronic measuring system within the pressure sensor 12. The helical compression spring 16 thus forms the electrical connection of the pressure sensor 12 to the circuit board 24.

A contact end section 36 of the helical compression spring 16, which faces away from the sensor-side end section 30 and faces the circuit board 24, rests with a mechanical preload of a suitable level on an upper side 38 of the contact plate 20 in order to establish an electrical contact. To maximize the effective electrical contact area between the contact end section 36 and the con-tact plate 20, the end section 40 of the helical compression spring 16 which is on the circuit board side is ground flat at the end. As an alternative, the surface geometry of the upper side 38 of the contact plate 20 can be designed to correspond to the geometry of the front end of the contact end section 36. A longitudinal center line 42 of the cylindrical helical compression spring 16 extends approximately perpendicularly to the upper side 38 of the contact plate 20 and to the housing underside 32 of the housing 34 of the pressure sensor 12.

The thickness 44 of the contact plate 20 is significantly greater than a thickness 46 of the conductor track 22 in order to ensure sufficient mechanical stability and, in particular, sufficient abrasion resistance of the contact plate 20.

An optional depression 48, e.g. a cup-like depression, can be formed in the contact plate 20 to ensure retention of the position of the contact end section 36 in respect of mechanical forces acting parallel to the upper side 38 of the contact plate 20. The surface geometry of the bottom 50 of the cup-like depression 48 can, in turn, be configured in such a way that it corresponds to the end shaping of the contact end section 36 of the helical compression spring 16 in order to minimize the electrical contact resistance, making it unnecessary to grind flat the end section 40 of the helical compression spring 16 on the circuit board side. The extent of the surface of the upper side 38 of the contact plate 20 is such that it extends beyond the contact end section 36 of the helical compression spring 16, preferably on all sides, giving a maximum electrical contact surface.

To increase the resistance of the connection arrangement 10 according to the invention to disadvantageous climatic effects, both the cylindrical helical compression spring 16 and the contact plate 20 are preferably provided with a passivated silver coating 60, 62 over the full surface area. The base material of the contact plate 20 is preferably a bronze alloy or a copper-tin alloy, in particular a CuSn6 alloy. In conjunction with the contact plate 20 soldered to the conductor track 22, outstanding resistance of the connection arrangement 10 both to chemical corrosion processes and to frictional corrosion processes is obtained.

The wire diameter d of a metal spring wire used to produce the cylindrical helical compression spring 16 and the outside diameter D of the helical compression spring 16 itself are dimensioned in such a way in relation to a total length L and number of turns or pitch angle $\alpha$ of the turns that the helical compression spring 16 does not buckle in a radial direction under the mechanical preload selected in order to create a sufficient contact pressure and under all the loads which act during operation in addition to the preload. In the illustrated axially preloaded state of the helical compression spring 16, the total length L corresponds to the vertical distance h between the housing underside 32 of the pressure sensor 12 and the upper side 38 of the contact plate 20 in the assembled state of the connection arrangement 10.

As a departure from the illustrative embodiment, shown by way of example, of the connection arrangement 10 with just one helical compression spring 16, a multiplicity of compression springs with a corresponding number of contact plates and helical compression springs is necessary to establish electrical contact between sensors and/or actuators that have more than one electrical terminal and/or a larger number of sensors and/or actuators and the conductor track 22 and further conductor tracks of the circuit board 24. In principle, it is possible here for more than one compression spring to be supported on one contact plate in each case in order, in particular, to optimize the current carrying capacity of the connection arrangement 10.

As regards the outlay on production, the contact plate 20 soldered onto the circuit board 24 can be regarded as neutral in comparison with previously known technical solutions since it can be processed using the same automatic SMD placement and soldering machines, for example, that are also used to place and solder the electronic and electrical components interconnected by means of the circuit board 24.

The application of the passivated silver coatings 60, 62 to the contact plate 20 and to at least the contact section of the helical compression spring 16 can likewise be performed in the course of the manufacturing process of the circuit board 24 by means of known coating methods. Moreover, the passivated silver coating 62 of the contact plate 20 facilitates the process of soldering the latter to the conductor track 22. After the completion of the connection arrangement 10, those regions of the conductor track 22 which are not covered by the soldered joint 28 can then be provided with a protection means in order also to protect the conductor tracks more effectively from damaging corrosive influences, the conductor tracks being formed by chemically pure copper or by a copper alloy. A suitable protective lacquer or the like can be used as a protective coating, for example.

Figure 2:
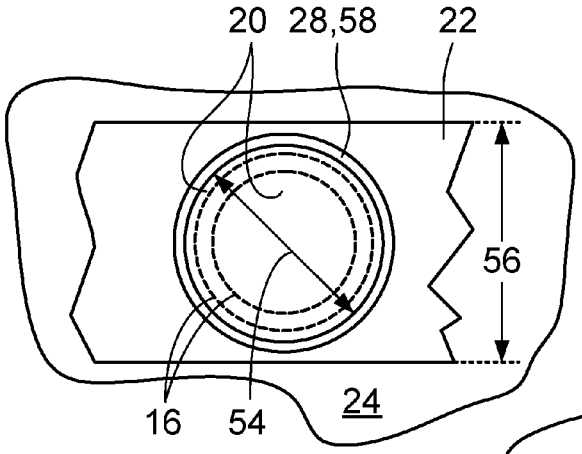
FIG. 2 shows a plan view of the contact plate in FIG. 1 with a conductor track situated underneath.

FIG. 2 shows a plan view of the contact plate 20 in FIG. 1 without the helical compression spring 16 with the conductor track 22 situated underneath. From the illustration it can first of all be seen that the contact plate 20 has a circular peripheral contour which concentrically surrounds the cross-sectional geometry of the cylindrical helical compression spring 16, here indicated only by dashed radial boundary lines, and thereby creates as large as possible a contact surface between the contact plate 20 and the helical compression spring 16.

The diameter 54 of the contact plate 20 is preferably at least slightly smaller than a width 56 of the conductor track 22 on the circuit board 24 in order to create a narrow edge zone, concentrically surrounding the contact plate 20, for a meniscus 58 of the soldered joint 28, the meniscus being annular in this case. As a consequence, the dimensions of the contact plate 20 and of the conductor track 22 on the circuit board 24 are preferably always such that the conductor track 22 extends at least slightly beyond the contact plate 20 on all sides.

Figure 3:
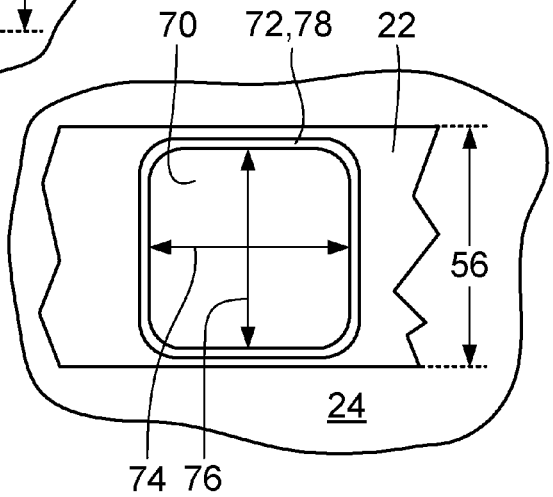
FIGS. 3 to 5 show a plan view of further embodiments of contact plates with the respective conductor track arranged underneath.

FIG. 3 shows another variant embodiment of a contact plate 70 having an approximately square peripheral contour with four corners, which are however slightly rounded, and the conductor track 22 arranged underneath. Once again, the contact plate 70 is connected conductively to the conductor track 22 on the circuit board 24 by a soldered joint 72. The width 74 and the length 76 of the contact plate 70 are each the same and, in this case, are preferably slightly smaller than the width 56 of the conductor track 22 on the circuit board 24 in order to provide an edge zone, encircling the contact plate 70, for a meniscus 78 of a soldered joint 72.

Figure 4:
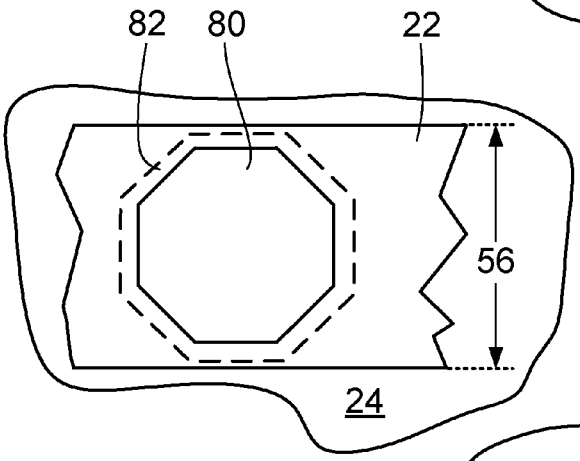
Figure 5:
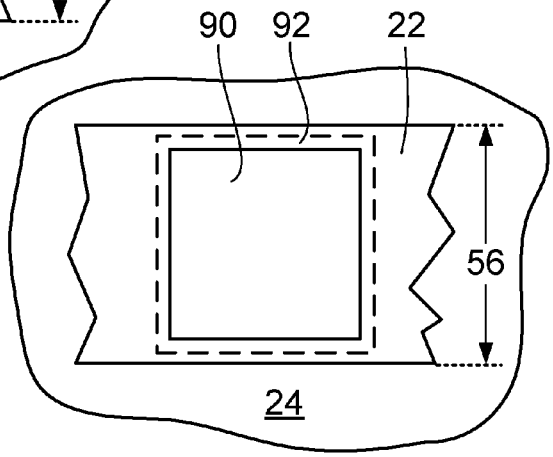

FIGS. 4 and 5 show a third embodiment of a contact plate 80 with a peripheral geometry which corresponds to that of an equilateral octagon, and a fourth embodiment of a contact plate 90, which has a rectangular or square peripheral geometry without rounded edges. The contact plates 80, 90 are each positioned on the underlying conductor track 22 of the circuit board 24 but have not yet been soldered to the conductor track 22. Two narrow edge zones 82, 92 surround the contact plates 80, 90 not yet soldered to the conductor track 22 of the circuit board 24, preferably on all sides, and serve as a propagation area for the meniscuses of the soldered joints, which are not shown here or are not yet present. As regards the width and length of the two contact plates 80, 90, the same statements apply in relation to the width 56 of the conductor track 22 as in the case of the contact plates 20, 70 shown in FIGS. 2 and 3 and already described above, and therefore attention is drawn at this point to the explanations relating to FIGS. 2 and 3.

Beyond the embodiments shown in FIGS. 2 to 5, contact plates with an oval, an elliptical or any combination of oval and/or elliptical peripheral geometries with at least one of the peripheral geometries shown in FIGS. 2 to 5 are possible. In principle, a peripheral geometry of a contact plate can have any desired profile, e.g. also a profile with multiple curves, as long as the contact plate extends beyond the contact end section of the at least one helical compression spring 16 associated therewith, preferably on all sides, and further-more does not extend beyond the conductor track associated therewith on any side.

In the case of peripheral geometries of the contact plates with edges which have a very small radius of curvature, however, the thickness of the applied passivated silver coating obtained in the edge region may be less in comparison with other surface zones of the contact plate.

While the above description constitutes the preferred embodiments of the present invention, it will be appreciated that the invention is susceptible to modification, variation and change without departing from the proper scope and fair meaning of the accompanying claims.

The invention claimed is:

1. A connection arrangement (10) for electrically connecting at least one sensor (12) or actuator to at least one conductor track (22) on a circuit board (24), the connection arrangement comprising:

the circuit board with the conductor track, at least one compression spring (18) for electrically conductive connection, the at least one compression spring (18) being configured to be under a mechanical preload when the connection arrangement is in a connected state, wherein the at least one compression spring (18) has a contact end section (36) facing the circuit board (24), and a contact plate (20, 70, 80, 90) electrically conductively connected to the conductor track (22), wherein the contact end section (36) of the at least one compression spring (18) rests against the contact plate (20, 70, 80, 90).

2. The connection arrangement as claimed in claim 1, wherein the contact plate (20, 70, 80, 90) has a thickness that is at least twice as great as a thickness (46) of the conductor track (22) to which the contact plate (20, 70, 80, 90) is configured to be electrically conductively connected.

3. The connection arrangement as claimed in claim 1, wherein the contact plate (20, 70, 80, 90) is formed with a copper-tin alloy.

4. The connection arrangement as claimed in claim 3, wherein the contact plate (20, 70, 80, 90) is formed from a CuSn6 alloy.

5. The connection arrangement as claimed in claim 1, wherein the compression spring (18) is provided with a passivated silver coating (60), at least on the contact end section (36).

6. The connection arrangement as claimed in claim 1, wherein the contact plate has an upper side (38) facing the contact end section (36) of the compression spring (18) and having a passivated silver coating (62).

7. The connection arrangement as claimed in claim 5, wherein the silver coating (60) of the compression spring (18) has a first coating thickness and the contact plate (20, 70, 80, 90) has a silver coating with a second coating thickness, wherein the first coating thickness and the second coating thickness are the same.

8. The connection arrangement as claimed in claim 7, wherein the first coating thickness and the second coating thickness are within a range of 2 μm to 5 μm.

9. The connection arrangement as claimed in claim 1, wherein an underside (26) of the contact plate (20, 70, 80, 90) is tin-coated, the underside facing the at least one conductor track (22).

10. The connection arrangement as claimed in claim 1, wherein the contact plate (20, 70, 80, 90) has an underside (26) soldered to the at least one conductor track (22) of the circuit board (24).

11. The connection arrangement as claimed in claim 1, wherein the contact plate (20, 70, 80, 90) has a surface that extends beyond the contact end section (36) of the compression spring (18) on all sides.

12. The connection arrangement as claimed in claim 1, wherein, around the contact plate (20, 70, 80, 90), the at least one conductor track (22) of the circuit board (24) has a surface that extends beyond the contact plate on all sides.

13. The connection arrangement as claimed in claim 1, wherein the contact plate (20, 70, 80, 90) has an upper side (38) with a depression (48) that at least partially accommodates the contact end section (36) of the at least one compression spring (18).

14. The connection arrangement as claimed in claim 1, wherein the compression spring (18) is a cylindrical helical compression spring (16).

15. The connection arrangement as claimed in claim 1, wherein the contact plate (20, 70, 80, 90) has a peripheral geometry selected from:

an at least quadrilateral peripheral geometry with or without rounded corners, a circular peripheral geometry, an elliptical peripheral geometry, or an oval peripheral geometry.

16. The connection arrangement as claimed in claim 1, further comprising at least one of a pressure sensor, a temperature sensor, a speed sensor, a displacement sensor, an acceleration sensor or a magnetic sensor forming the at least one sensor, or comprising at least one of a solenoid valve, a servomotor, an electromagnet, or a piezo stack forming the at least one actuator.

17. The connection arrangement as claimed in claim 1, further including at least one solenoid valve forming the at least one actuator.

* * * * *